US005266732A

United States Patent [19]

Suzuki

[11] Patent Number: 5,266,732

[45] Date of Patent: Nov. 30, 1993

[54] AUTOMATIC PERFORMANCE DEVICE FOR SOUNDING PERCUSSION INSTRUMENTS

[75] Inventor: Kunihiko Suzuki, Enoki, Japan

[73] Assignee: Kabushiki Kaisha Bell Music, Tokyo, Japan

[21] Appl. No.: 926,967

[22] Filed: Aug. 7, 1992

[51] Int. Cl.[5] ..... G10F 1/10

[52] U.S. Cl. ..... 84/103; 84/464 R; 84/407

[58] Field of Search ..... 84/3, 102-104, 84/609, 406, 407, 464 R, 403-405

[56] References Cited

U.S. PATENT DOCUMENTS

| | | | |
|---|---|---|---|
| 561,881 | 6/1896 | Gerry et al. | 84/103 |
| 2,844,986 | 7/1958 | Boda | 84/405 |
| 3,046,826 | 7/1962 | Kramer | 84/405 |
| 3,229,021 | 1/1966 | Baschet | 84/404 X |
| 3,769,870 | 11/1973 | Huber | 84/103 |
| 4,092,893 | 6/1978 | Beach | 84/103 X |
| 4,250.787 | 2/1981 | Segan et al. | 84/464 R |
| 4,854,214 | 8/1989 | Lowe | 84/464 R X |
| 5,079,984 | 1/1992 | Kosugi et al. | 84/645 |

FOREIGN PATENT DOCUMENTS 0239917 10/1987 European Pat. Off. .

OTHER PUBLICATIONS

United Kingdom Search Report, Apr. 28, 1992, Search Examiner: S. E. Willcox.

*Primary Examiner*—William M. Shoop, Jr.
*Assistant Examiner*—Jeffrey W. Donels
*Attorney, Agent, or Firm*—Hedman, Gibson & Costigan

[57] ABSTRACT

An automatic performance device includes a sound signal generation section for generating a sound signal, a loudspeaker for sounding the sound signal generated by the sound signal generation section, percussion instruments constituting a scale, a percussion instrument drive section for sounding the percussion instruments, a percussion instrument performance information output section for outputting percussion instrument performance information in synchronism with the sound signal, and a converter for converting the percussion instrument performance information to a corresponding drive signal of the percussion instrument drive section. An atmosphere of a live performance is produced and a rich and powerful musical performance as an orchestral performance can be simultaneously made as an accompanying music in a simple manner.

8 Claims, 9 Drawing Sheets

AUTOMATIC PERFORMANCE DEVICE FOR SOUNDING PERCUSSION INSTRUMENTS

BACKGROUND OF THE INVENTION

This invention relates to an automatic performance device enabling a listener to enjoy an atmosphere of a live performance and to enjoy a rich and powerful music at any time and in a simple manner in a desired outdoor or indoor place such as a banquet hall for a wedding reception, a lounge in a hotel and a hall.

Music such as a background music which one listens to in a banquet hall for a wedding reception or a hotel lounge includes music which is either music reproduced from a Compact Disc, record or tape and sounded from a loudspeaker, or a live music performance of, e.g., a piano or string quartet, or an automatic performance of, e.g., a piano or a carillon.

The system of sounding reproduced music of a Compact Disc, record or tape from a loudspeaker fails to give an atmosphere of a live performance to the audience. The live performance of a piano or string quartet needs a performer so that it is not always available and besides it is costly. The automatic performance of a piano or a carillon gives an atmosphere of a live performance to the audience but, since this is performance of a single musical instrument, a rich and vivid musical atmosphere such as produced by an orchestra performance cannot be obtained.

It is, therefore, an object of the invention to provide an automatic performance device enabling audience to enjoy an atmosphere of a live performance in a desired place and to enjoy a rich and powerful musical performance at any time and in a simple manner.

SUMMARY OF THE INVENTION

An automatic performance device achieving the above described object of the invention comprises sound signal generation means for generating a sound signal, a loudspeaker for sounding the sound signal generated by the sound signal generation means, percussion instruments constituting a scale, percussion instrument drive means for sounding the percussion instruments, percussion instrument performance information output means for outputting percussion instrument performance information in synchronism with the sound signal, and conversion means for converting the percussion instrument performance information to a corresponding drive signal of the percussion instrument drive means.

In one aspect of the invention, an automatic performance device comprises percussion instruments constituting a scale, percussion instrument drive means for sounding the percussion instruments, percussion instrument information generation means for generating percussion instrument performance information driving the percussion instrument drive means, conversion means for converting the percussion instrument performance information to a corresponding drive signal of the percussion instrument drive means, vibration detection means for detecting vibration of the percussion instruments, sound signal generation means for generating a sound signal in response to a detection signal provided by the vibration detection means, and a loudspeaker for sounding the sound signal generated by the sound signal generation means.

According to the invention, a sound signal is sounded from a loudspeaker and a percussion instrument which is synchronized with this sound signal is automatically performed. An atmosphere of a live performance is produced by sounding of the percussion instrument and, at the same time, a rich and powerful musical performance can be enjoyed at any time and in a simple manner by performance of an accompanying tone of an orchestra or the like by the sound signal.

In one aspect of the invention, by driving percussion instruments of the same tone pitch simultaneously, sound of a large volume can be obtained.

By employing, as the percussion instrument drive means, the hammer which is driven by the solenoid, the percussion instruments can be sounded easily.

The percussion instrument performance information containing information which emphasizes or deemphasizes the drive force of the percussion instrument drive means enable production of a percussion instrument sound which is emphasized or deemphasized.

By constructing the percussion instruments by bells, an atmosphere of a live performance of bells can be produced.

By providing lamps at or in the vicinity of locations of the respective percussion instruments and driving a corresponding one of the lamps in accordance with the percussion instrument performance information, a visual effect can also be produced.

By constructing the sound signal generation means by the music information output means for outputting music information and the sound source which is driven by the music signal to generate a sound signal based on a synthesized sound, the synthesized sound and the percussion instrument sound can be synchronously performed.

By constructing the sound signal generation means by the sound signal recording medium reproduction means for reproducing a sound signal from the sound signal recording medium on which the sound signal is recorded, the reproduced sound and the percussion instrument sound can be synchronously performed.

By employing a MIDI signal as the percussion instrument performance information, the control of the device can be facilitated.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Embodiment 1

An embodiment of the invention in which the percussion instruments are made of bells and a sound signal is prepared as a synthetic sound formed by a sequencer or a computer will first be described.

Figure 2:
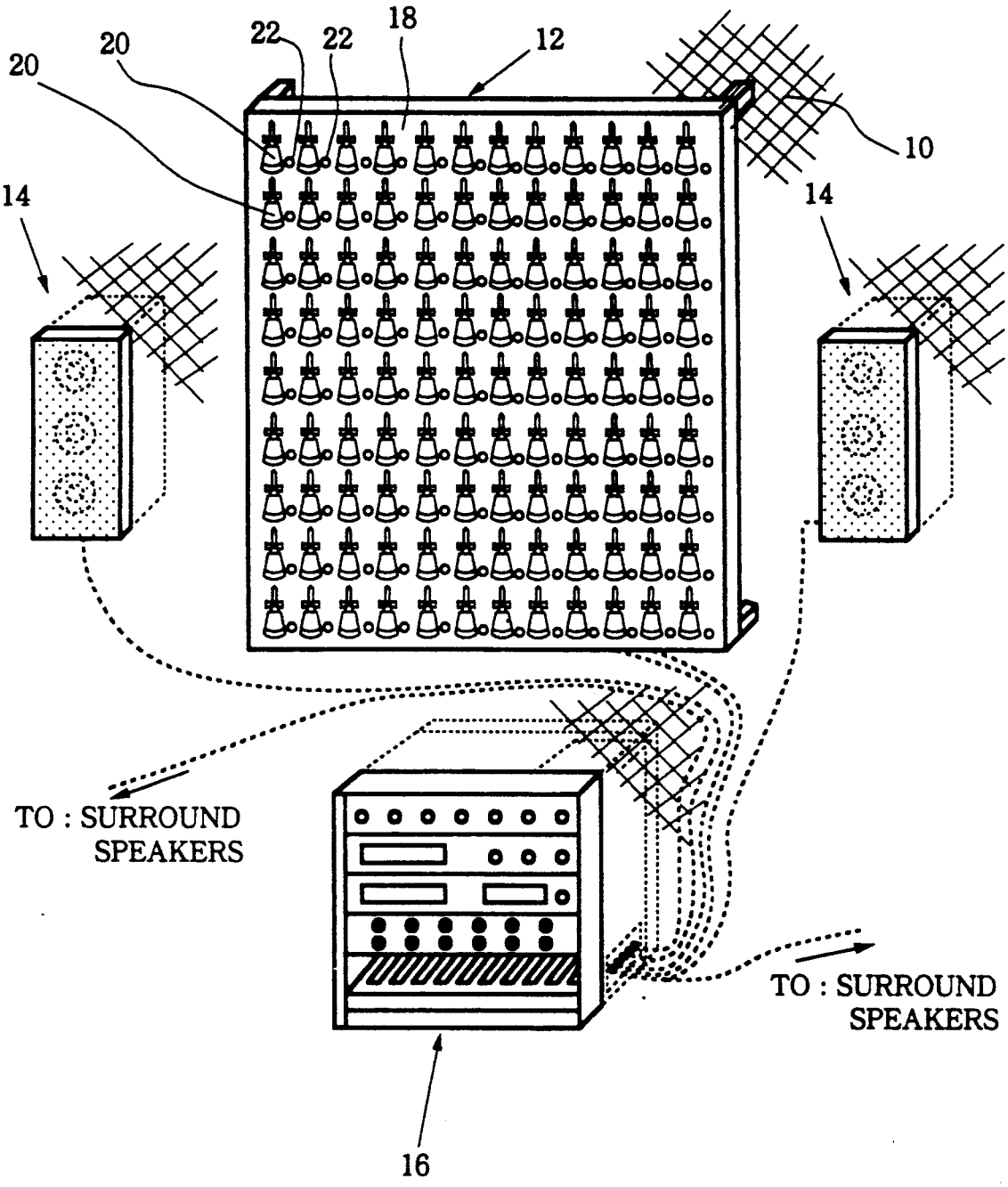
FIG. 2 is a view showing an entire structure of the embodiment of the invention.

FIG. 2 shows an entire construction of the automatic performance device according to this embodiment. A bell board 12 and loudspeakers 14 for propagating sound signals as bell sound are mounted on a wall surface 10 of a selected place such as a banquet hall for a wedding reception, a lounge of a hotel or a hall. A controller unit 16 is also disposed at other proper place for transmitting a drive signal for driving the bells and transmitting a sound signal to the loudspeakers 14.

The bell board 12 is constructed of a plurality of bells 20 which are arranged on a board 18 made of synthetic resin or metal. These bells 20 constitute a scale and several bells are allotted to the same tone pitch. For example, the scale of 20 notes, i.e., 12 notes of A, B, C, D, E, F, G, A, B, C, D, E and 8 semitones coming between these notes, is used and 5 bells for each note, totalling 100 bells 20, are arranged regularly in the order of the scale or at random. Bells which are of the same tone pitch but have different tone colors may also be used.

In the vicinity of the respective bells 20 on the board 18 are provided lamps 22. A lamp 22 which is near a currently sounding bell 20 is lighted thereby producing a visual effect.

The bell board 12 is not limited to a square board but it may be formed in other shape such as circle, triangle or a shape of an animal or plant or building or the like.

Figure 3:
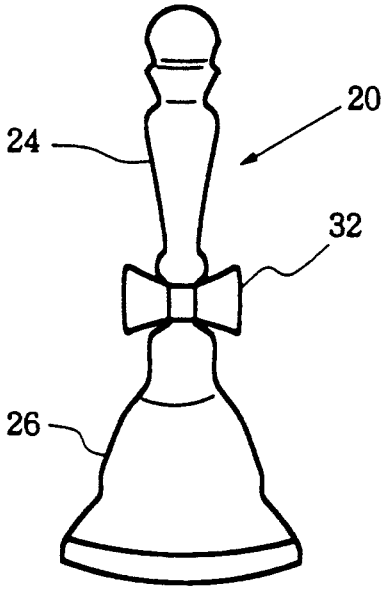
FIG. 3 is a front view of a bell 20 in FIG. 2.
Figure 4:
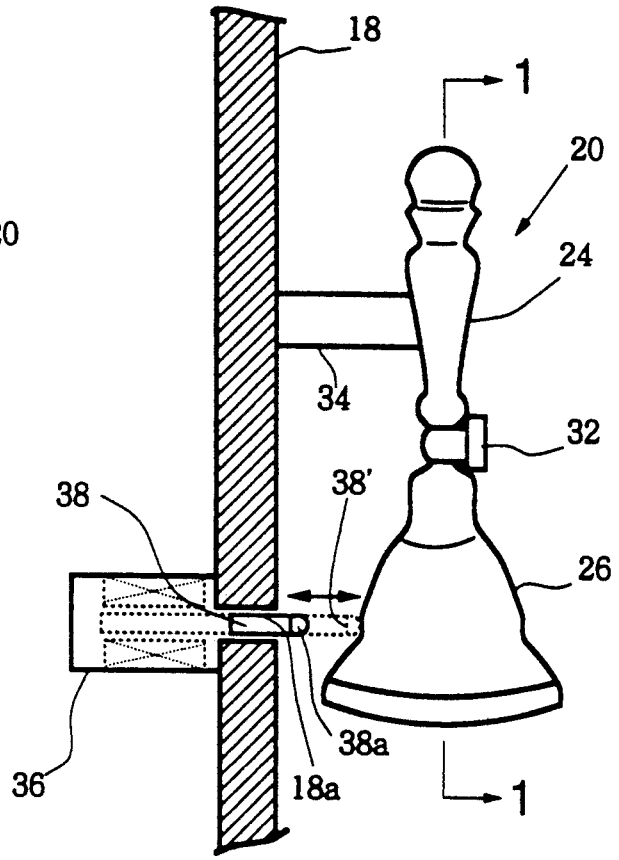
FIG. 4 is a side view of the bell 20.
Figure 5:
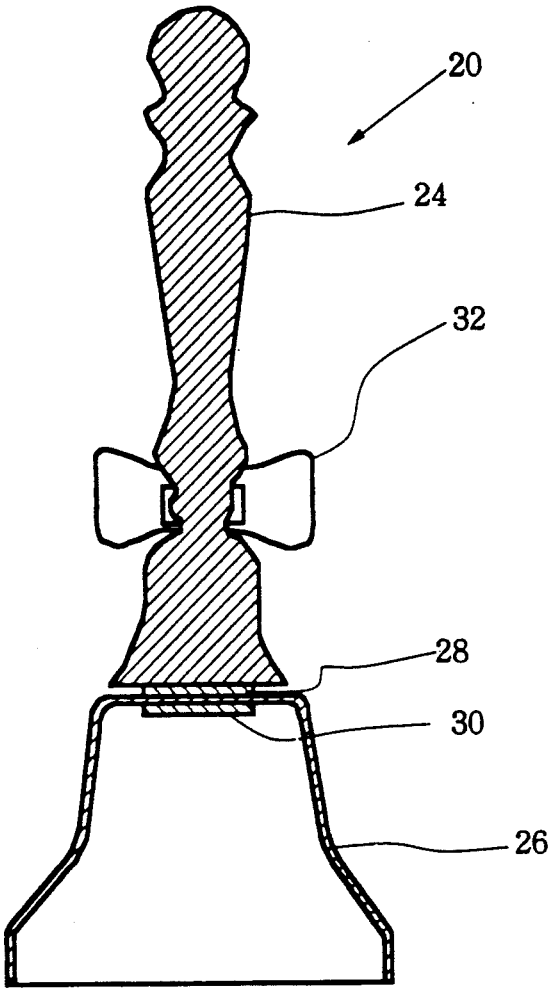
FIG. 5 is a view taken along arrows A—A in FIG. 4.

An example of the bell 20 is shown in FIGS. 3 to 5. FIG. 3 is a front view of the bell 20, FIG. 4 is a side view showing a state of the bell 20 mounted on the board and FIG. 5 is a view taken along arrows A—A in FIG. 4. This bell 20 is made in the form of a handbell and has, as shown in FIG. 5, a handle 24 and a bell body 26. A cushion material 28 such as rubber is interposed between the handle 24 and the bell body 26 and a bolt 30 is inserted from the inside of the bell body 26 into the lower end portion of the handle 24. A decoration 32 is mounted on the handle 24.

This bell 20 is secured to the board 18 through an arm 34 connected to the handle 24.

On the back surface of the board 18 is mounted a solenoid-plunger 36 which constitutes the percussion instrument drive means. A movable rod 38 of the solenoid plunger 36 extends through an opening 18*a* formed in the board 18 to a location beside the bell body 26.

When the solenoid-plunger 36 is actuated with a short pulse, the movable rod 38 is reciprocated instantaneously as shown by a chain-and-dot line 38*a'* and a tip portion 38*a* thereof made of synthetic resin or rubber strikes the bell body 26 to produce a bell sound.

Figure 1:
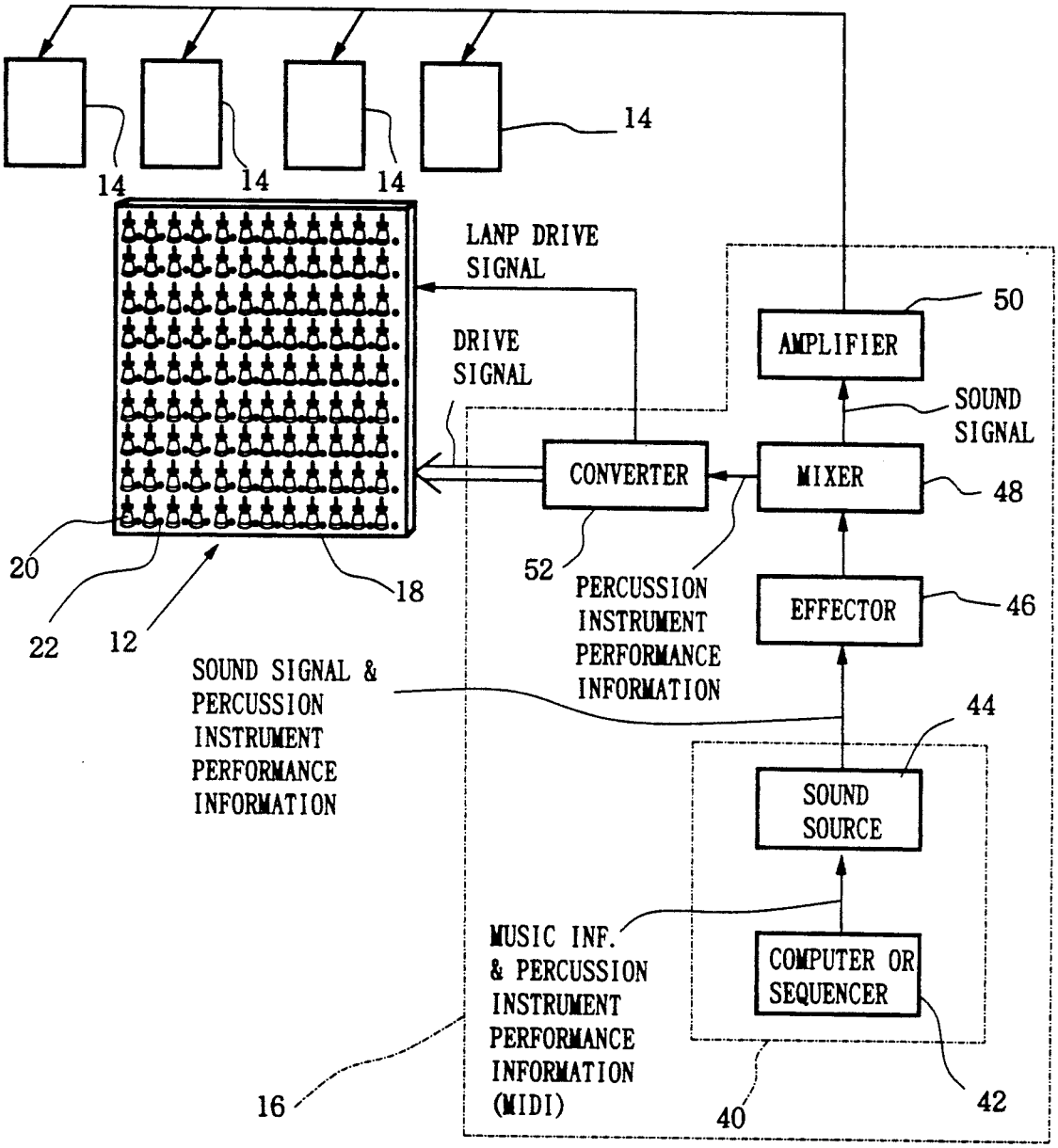
FIG. 1 is a control block diagram showing a specific example of a controller unit 1 of an embodiment of the invention.

A specific example of the controller unit 16 of the automatic performance device of FIG. 2 is shown in FIG. 1. The controller unit 16 includes, as sound signal generation means and percussion instrument performance output means 40, a computer or sequencer 42 and a sound source 44. The computer or sequencer 42 sequentially produces music information for driving the sound source 44 and percussion instrument performance information for sounding the bell 20 in the form of a MIDI (musical instrument digital interface) signal in synchronism with this music information in accordance with a preset program. As the sequencer, QX3 (trademark) made by Yamaha Corporation, for example, may be employed. When a computer is used, a MIDI interface is attached to the computer and a software for a music sequencer is used. For example, PRELUDE (trademark) of Dynaware Corporation may be combined with a PC-9800 personal computer of NEC Corporation and Performer (trademark) may be combined with a McIntosh personal computer of Apple Computer Inc.

The computer or sequencer 12 may also be interlocked with a timer so as to cause the automatic performance device to perform time telling function.

The music information produced by the computer or sequencer 42 is composed of information which designates tone pitch, length and level of a tone etc. with respect to tones of plural musical instruments (i.e., channels). By designating sounding of tones of plural musical instruments, the music information can realize an orchestra performance or the like performance.

The percussion instrument performance information is composed of information designating tone pitch and level of tones and is provided through a particular channel of the computer or sequencer 42 in synchronism with the music information. This percussion instrument performance information can designate sounding of plural bells simultaneously (e.g., sounding a chord).

The sound source 44 is driven by the music information to produce sound signals of corresponding musical instruments from individual channels. As the sound source 44, PROTEUS (trademark) for MIDI system made by E-mu Systems Inc. and MIR (trademark) made by Kabushiki Kaisha KORG may be used. By using these sound sources concurrently, the number of tones which can be produced simultaneously can be increased.

The percussion instrument performance information passes through the sound source 44.

The sound signal output from the sound source 44 is subjected to a effect processing, mixing or tone volume adjustment, when necessary, by an effector 46 and a mixer 48 for the MIDI system and thereafter is synthesized to left and right channel signals and delivered out. As the effector 46 and mixer 48, for example, DMP11 (trademark) made by Yamaha Corporation may be used. The output of the mixer 48 is amplified by an amplifier 50 and sounded from the loudspeakers 14. A surround effect may be imparted, if necessary, to the sound signal to increase presence.

The percussion instrument performance information is applied to a converter 52. The converter 52 converts the percussion instrument performance information in the form of a MIDI signal which has been provided through the effector 46 and the mixer 48 to a solenoid-plunger drive signal for a corresponding bell. More specifically, the converter 52 outputs a shot of pulse voltage having a voltage level corresponding to level information in the percussion instrument performance information to a bell corresponding to tone pitch information in the percussion instrument performance information. The entire level of the drive signal may be adjusted by a volume or the like device provided in the converter 52 if necessary so that the strength of striking the bells, i.e., sound volume, will be adjusted as a whole. The output of the converter 52 is applied to a solenoid-plunger of a corresponding bell to sound the bell. The bells of the same tone pitch are sounded simultaneously.

In the above described manner, a bell sound is produced with melody and level designated respectively by the percussion instrument performance information and in synchronism with sound propagated from the loudspeakers 14. By performing melody with the bells 20 and performing accompanying tones by an orchestra from the loudspeakers 14, therefore, an atmosphere of a live performance by the bells and a rich and powerful music by the orchestra are harmonized with each other and a unique automatic performance effect which is not experienced in the conventional automatic performance can be realized.

Further, by the output of the converter 52, the lamps 22 in the vicinity of the sounded bells 20 are lighted whereby a merry and pleasant visual effect can be realized.

Embodiment 2

Figure 6:
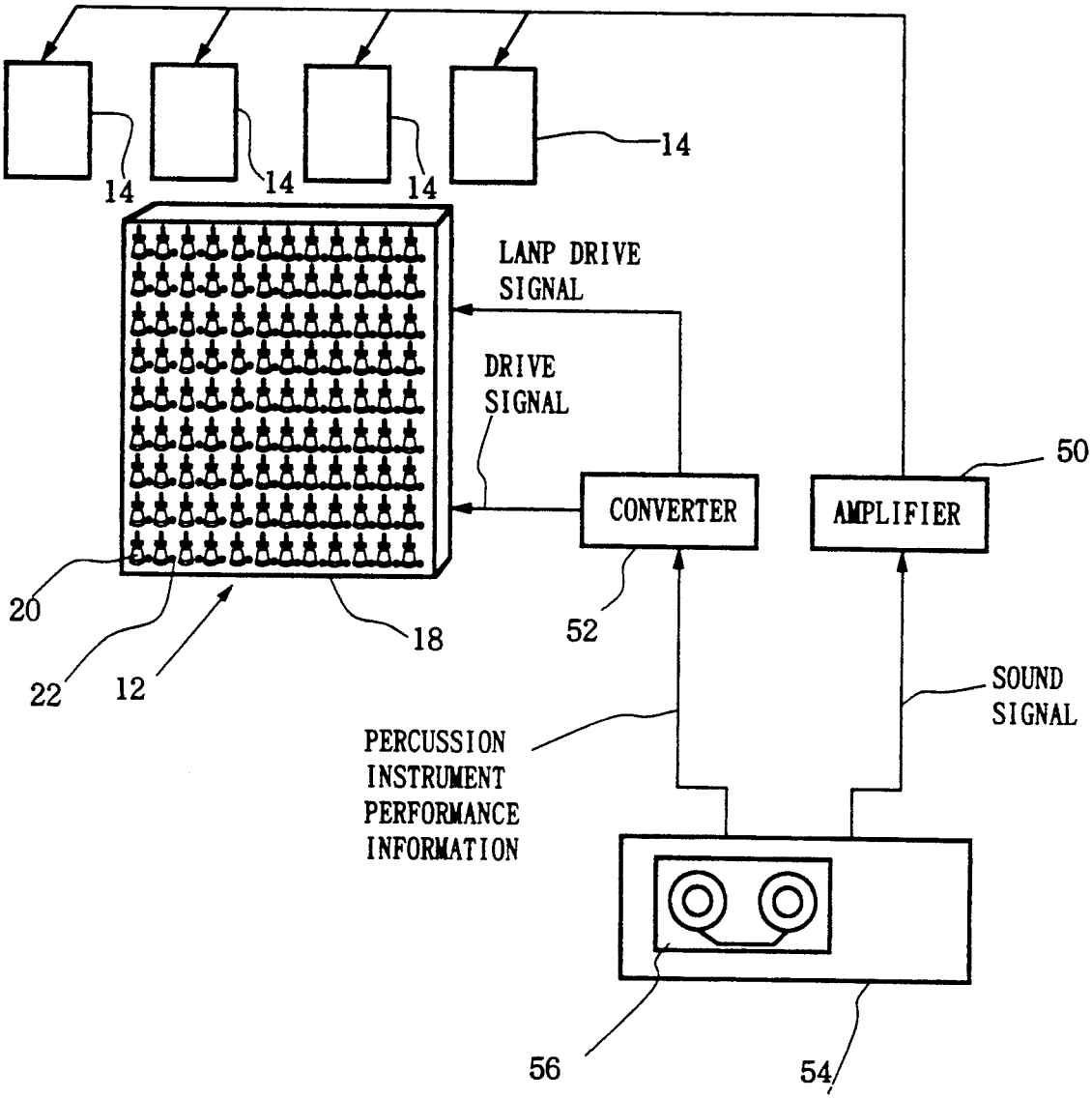
FIG. 6 is a control block diagram showing another embodiment of the invention.

In the above described embodiment, the sound signal is prepared on the basis of a synthesized signal. The sound signal may also be made by using a sound reproduction device. An embodiment of the latter case will be described with reference to FIG. 6.

A sound reproduction device 54 is made in the form of a Compact Disc player, a tape recorder or the like. A sound signal and percussion instrument performance information synchronized with the sound signal are recorded on separate tracks of a sound signal recording medium 56. By playing back this recording medium 56, a stereophonic sound signal and percussion instrument performance information are produced from separate channels of the sound reproduction device 54. The sound signal is sounded from loudspeakers 14 through an amplifier 50. The percussion instrument performance information is converted by a converter 52 to a solenoid-plunger drive signal for sounding the bells 20 and a lamp drive signal for lighting the lamps 22 and supplied to a bell board 12.

By this arrangement, the bells are sounded in synchronism with sound from the loudspeakers 14 whereby the same effect as in the above described embodiment 1 can be obtained.

Instead of recording the percussion instrument performance information in the recording medium itself, a synchronizing signal may be recorded in the recording medium 56 and this synchronizing signal reproduced from the recording medium 56 may be used for driving the computer or sequencer to produce percussion instrument performance information.

Embodiment 3

Figure 7:
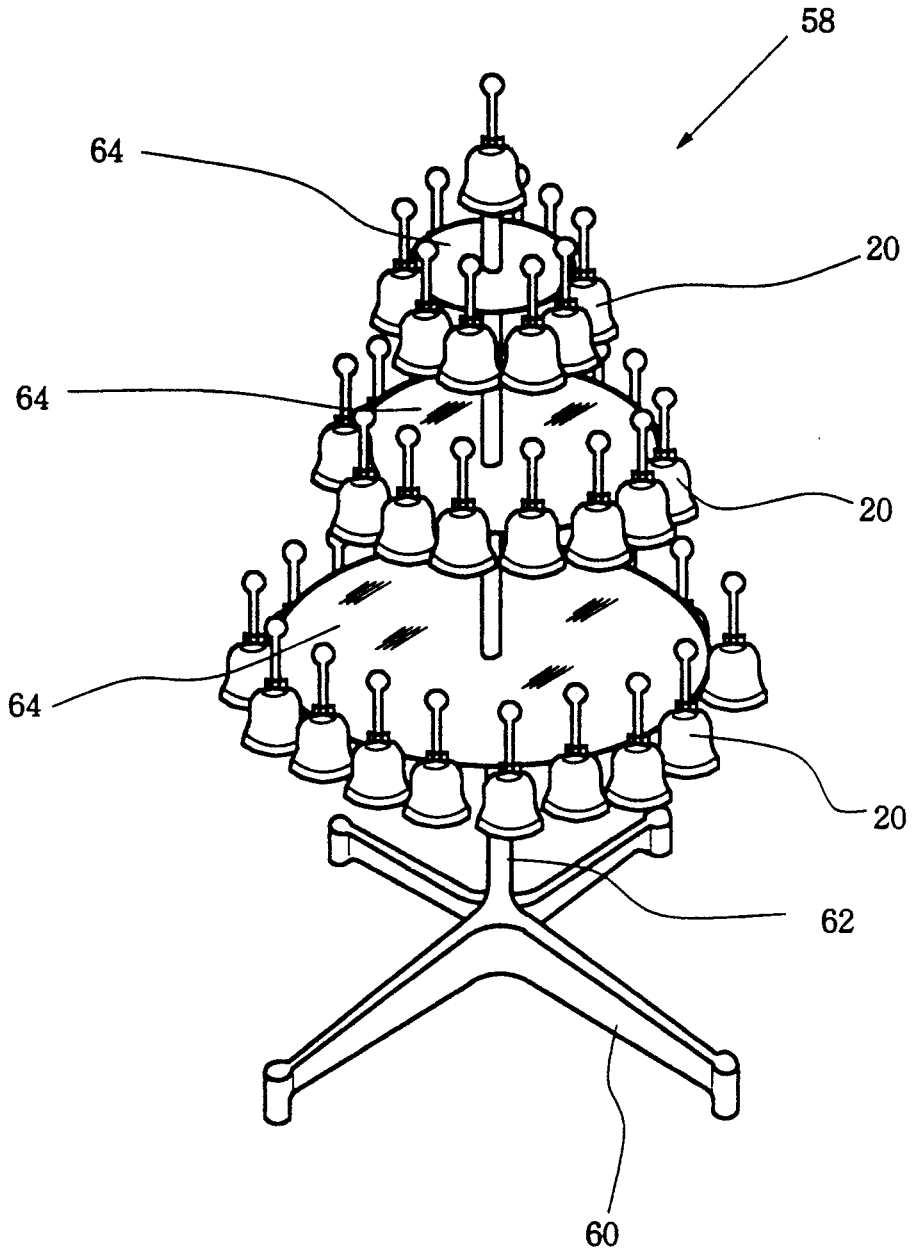
FIG. 7 is a perspective view showing another example of arrangement of the bell.

In the above described embodiments 1 and 2, the bell board 12 is employed. Alternatively, bells 20 may be suspended in the form of a tree as shown in FIG. 7. This bell tree 58 has a pole 62 erected in the center of a leg 60 and disks 64 are mounted to the pole 62 at different heights. Bells 20 are mounted to the peripheral portions of the disks 64. If necessary, sets of bells of the same tone pitch may be provided.

Figure 8:
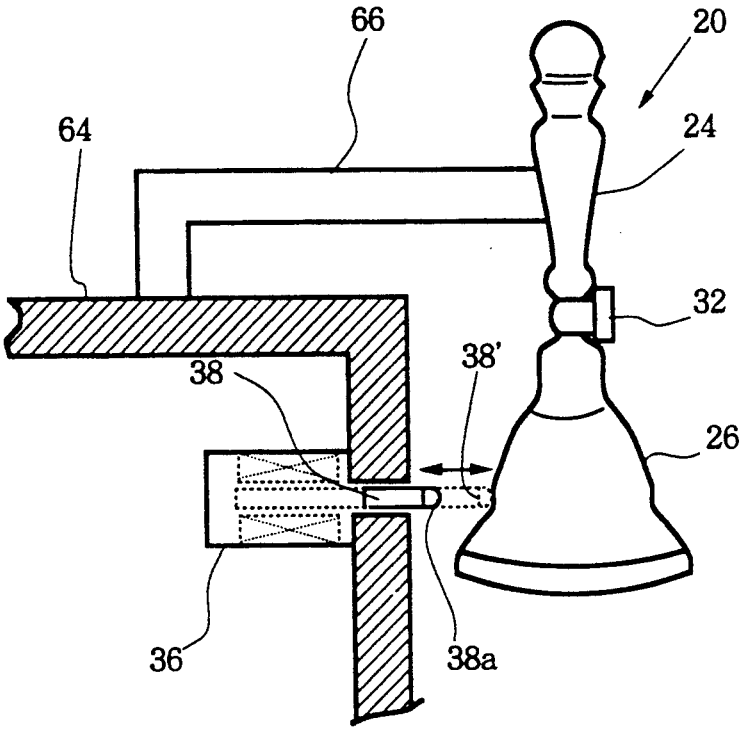
FIG. 8 is a side view of the bell in FIG. 7.

Each of the bells 20 is mounted, as shown in FIG. 8, to the disk 64 through an arm 66 and is struck by a movable rod 38 of a solenoid-plunger 36 provided on the back surface of the disk 64 to produce a bell sound.

Embodiment 4

Figure 9:
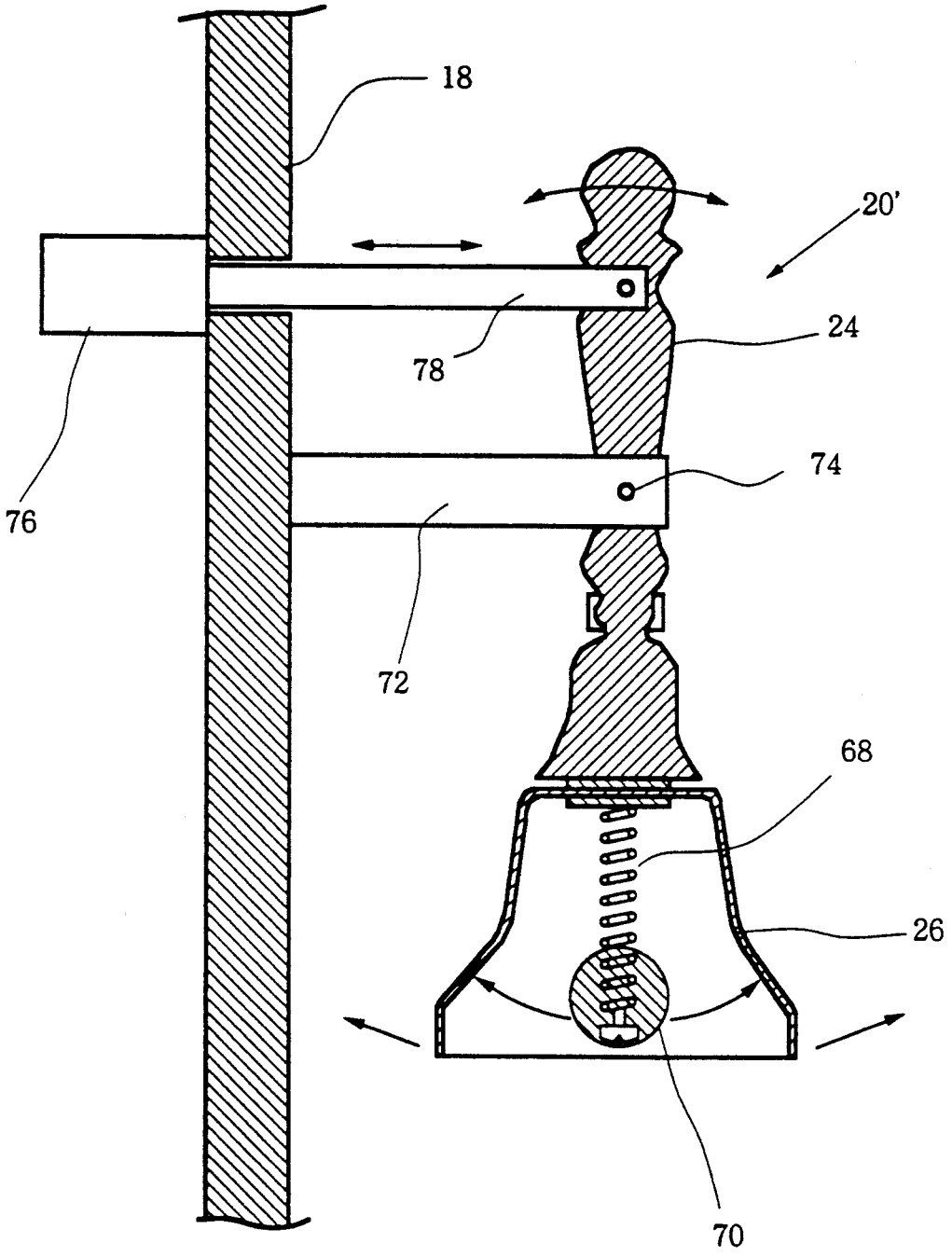
FIG. 9 is a side sectional view of another example of bell.

In the above described embodiments 1 to 3, the bell 20 is struck by the hammer (i.e., the movable rod 38) to produce a bell sound. Alternatively, as a bell 20' shown in FIG. 9, the bell may be constructed in such a manner that a ball 70 made of rubber or synthetic resin is suspended from the bell body 26 through a coil spring 68, the central portion of a handle 24 is pivotally supported about a pin 74 on an arm 72 and a rod 78 of a drive device 76 such as a plunger is connected to the upper portion of the handle 24. By driving the drive device 76, the bell 20 is caused to swing back and forth whereby the ball 70 strikes the bell body 26 to produce a bell sound. By causing the bell 20 to swing continuously, a continuous sound can be produced (by inserting information representing length of a tone in the percussion instrument performance information). According to this structure, the bell 20 itself is moved so that a merry and pleasant visual effect can be realized.

Embodiment 5

Figure 10:
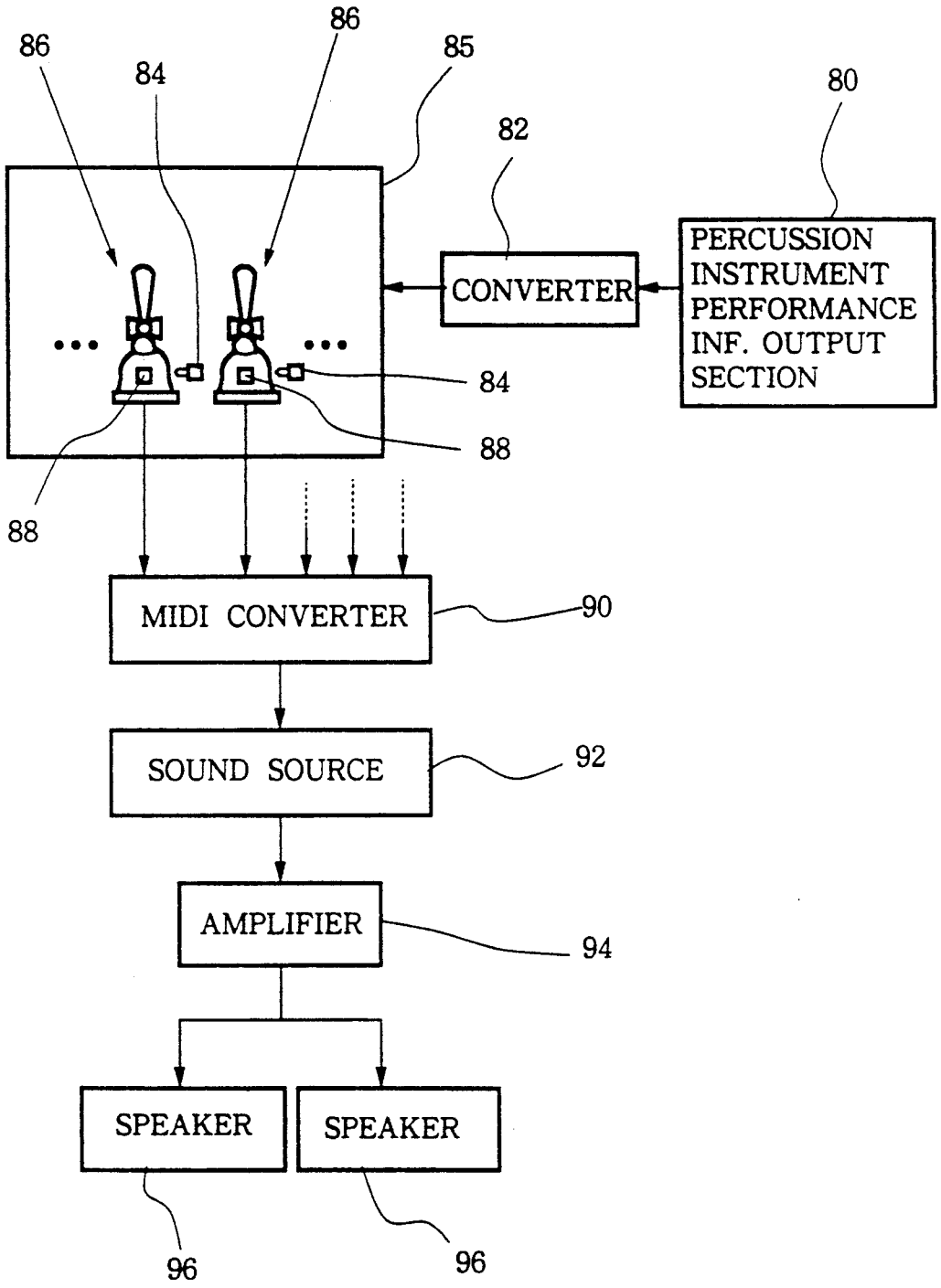
FIG. 10 is a control block diagram showing still another embodiment of the invention.

In the above described embodiments, the sound signal is provided by the computer or sequencer or sound reproduction device. Alternatively, as shown in FIG. 10, vibration of a percussion instrument may be detected and a sound signal may be produced on the basis of a vibration detection signal. In FIG. 10, a percussion instrument performance information output section 80 is made, for example, of a computer or sequencer and produces percussion instrument performance information. This percussion instrument performance information is converted by a converter 82 to a drive signal for driving a percussion instrument drive section 84. Bells 86 constituting a scale are arranged on a bell board 85. The percussion instrument drive section 84 is driven by the drive signal to strike the bells 86 to produce a bell sound.

To each of the bells 86 is mounted a vibration detection element 88 such as a piezo-electric element and striking of each bell is detected by detecting its vibration. This detection signal is applied to a MIDI converter 90 (e.g., ME35T (trademark) made by Akai Electric Co., Ltd) and converted to a music signal (MIDI signal). By driving a sound source 92 by the conversion output, a sound signal of a set tone color is produced. This sound signal is supplied to loudspeakers 96 through an amplifier 94 whereby a sound signal synchronized with sound of the bell 86 is sounded.

Modified embodiments

In the embodiments 1 and 2, the bells 20 are arranged on the board 18. The bells may be arranged on other structure such as a metal frame instead of the board 18. The bells may also be directly mounted on the wall.

In these embodiments, bells of the same tone pitch are sounded simultaneously. Alternatively, tone volume may be adjusted by sequentially changing the number of bells to be sounded.

In these embodiments, the sound signal generation means and the percussion instrument performance output means are integrally constructed. Alternatively, these means may be separately provided and driven in synchronization with each other.

In these embodiments, the solenoid-plunger is used as the percussion instrument drive means. However, an electrical motor or other drive means may be employed.

In these embodiments, bells are used as the percussion instrument. Other type of percussion instrument may also be used.

The automatic performance device according to the invention may be provided not only an indoor place but also in outdoor places such as an outdoor wall surface or outdoor structure.

In a case where sufficient tone volume of percussion instruments cannot be obtained in an outdoor place or a broad indoor place, a microphone may be provided near the percussion instruments so that the sound of the percussion instruments is amplified by an amplifier and thereafter is sounded.

What is claimed is:

1. An automatic performance device comprising:

sound signal generation means for generating a sound signal;

a loudspeaker for sounding the sound signal generation means;

percussion instruments constituting a scale;

percussion instrument performance information output means for outputting percussion instrument performance information in synchronization with the sound signal;

conversion means for converting the percussion instrument information to a corresponding drive signal of the percussion instrument drive means;

wherein there are provided a plurality of percussion instruments, some of which have the same tone pitch and each of the percussion instruments having percussion instrument drive means, said percussion instrument drive means being capable of simultaneously driving the percussion instruments of the same tone pitch in accordance with said percussion instrument performance information.

2. An automatic performance device as defined in claim 1 wherein said percussion instrument drive means is a hammer driven by a solenoid-plunger.

3. An automatic performance device as defined in claim 1 wherein said percussion instrument performance information contains information which emphasizes or deemphasizes the driving force of the percussion instrument drive means.

4. An automatic performance device as defined in claims 1 wherein said percussion instruments are bells.

5. An automatic performance device as defined in claim 1 further comprising lamps provided at or in the vicinity of locations of the respective percussion instruments and lamp drive means for lighting one of the lamps at a corresponding location in accordance with the percussion instrument performance information.

6. An automatic performance device as defined in claim 1 wherein said sound signal generation means comprises music information output means for outputting music information and a sound source driven by this music signal to generate a sound signal based on a synthesized sound.

7. An automatic performance device as defined in claim 1 wherein said sound signal generation means is constructed of sound signal recording medium reproduction means for reproducing a sound signal from a sound signal recording medium on which the sound signal is recorded.

8. An automatic performance device as defined in claim 1 wherein said percussion instrument performance information is made of a MIDI signal.

* * * * *